US012471683B2

(12) United States Patent
Xue et al.

(10) Patent No.: US 12,471,683 B2
(45) Date of Patent: Nov. 18, 2025

(54) JEWELRY ITEM

(71) Applicant: FORSTYLES LLC, Reno, NV (US)

(72) Inventors: Xiaoxin Xue, Edmonton (CA); Xiaohui Xue, Huizhou (CN); Yiheng Xue, Huizhou (CN)

(73) Assignee: FORSTYLES LLC, Reno, NV (US)

( * ) Notice: Subject to any disclaimer, the term of this patent is extended or adjusted under 35 U.S.C. 154(b) by 117 days.

(21) Appl. No.: 18/399,657

(22) Filed: Dec. 28, 2023

(65) Prior Publication Data

US 2024/0130488 A1 Apr. 25, 2024

Related U.S. Application Data

(63) Continuation of application No. PCT/CN2021/142383, filed on Dec. 29, 2021.

(30) Foreign Application Priority Data

Nov. 8, 2021 (CN) ..... 202111313500.7

(51) Int. Cl.
*A44C 9/00* (2006.01)
*A44C 17/02* (2006.01)

(52) U.S. Cl.
CPC ..... *A44C 9/0007* (2013.01); *A44C 17/02* (2013.01)

(58) Field of Classification Search
CPC . A44C 17/0225; A44C 17/0233; A44C 17/02; A44C 9/0007; A44C 9/0015; A44C 9/0023

(Continued)

(56) References Cited

U.S. PATENT DOCUMENTS 4,080,803 A * 3/1978 Suzuki ..... A44C 9/0023 63/15.4
5,228,316 A * 7/1993 Meyrowitz ..... A44C 17/0258 63/15.4

(Continued)

FOREIGN PATENT DOCUMENTS

CH 704422 A2 * 7/2012 ..... A44C 9/003
CN 201243679 Y * 5/2009

(Continued)

OTHER PUBLICATIONS

International Search Report issued in corresponding International application No. PCT/CN2021/142383, mailed Jun. 27, 2022 (8 pages).

(Continued)

*Primary Examiner* — Jason W San
*Assistant Examiner* — Anna S Rashid

(57) ABSTRACT

A jewelry item includes an inner ring base, an inner ring arranged on the inner ring base, and a decorative body. A slot is provided on an outer surface of the inner ring base. The inner ring defines a through hole at a position corresponding to the slot. The decorative body includes a mounting column. The mounting column passes through the through hole and is limited in the slot. The decorative body is limited to the inner ring base by a triple limit locking structure, which completely prevents the decorative body and inner ring base from detaching. The limit locking structure is very simple and ingenious. The jewelry item is able to be assembled and disassembled by hands without using tools. Compared with the prior art, the jewelry item is more convenient for a user to assemble, which improves assembly time and efficiency.

8 Claims, 6 Drawing Sheets

(58) Field of Classification Search
USPC ..... 63/15.1, 15.2, 15.3; 29/10, 40
See application file for complete search history.

(56) References Cited

U.S. PATENT DOCUMENTS

| | | | | |
|---|---|---|---|---|
| 5,228,317 | A * | 7/1993 | Hendricks | A44C 17/0208 63/29.1 |
| 8,316,666 | B2 * | 11/2012 | Patterson | A44C 17/0216 63/15.4 |
| 9,516,931 | B2 * | 12/2016 | Mencagli | A41D 27/08 |
| 9,848,678 | B2 * | 12/2017 | Drouhard | A44C 17/0208 |
| 10,251,456 | B2 * | 4/2019 | Heinz | A44C 9/0015 |
| 10,646,009 | B2 * | 5/2020 | Song | C22C 29/02 |
| 11,197,522 | B2 * | 12/2021 | Hall | A44C 25/007 |
| 11,464,302 | B1 * | 10/2022 | Butler | A44C 17/0208 |
| 11,766,100 | B1 * | 9/2023 | Butler | A44C 17/0216 63/29.1 |
| 11,937,671 | B2 * | 3/2024 | Crowley | A44C 5/0084 |
| 2004/0255620 | A1 * | 12/2004 | Chuang | A44C 15/001 63/29.1 |
| 2011/0011131 | A1 * | 1/2011 | Bisserier | A44C 9/0023 63/15.7 |
| 2012/0180522 | A1 * | 7/2012 | Severs | A44C 17/0208 63/12 |
| 2012/0198887 | A1 * | 8/2012 | Bisserier | A44C 9/0015 63/15 |
| 2012/0222449 | A1 * | 9/2012 | Johnson | B32B 3/08 63/15.2 |
| 2014/0075988 | A1 * | 3/2014 | Matysik | A44C 9/0084 63/15.2 |
| 2014/0196500 | A1 * | 7/2014 | Machini | A44C 9/003 63/15 |
| 2015/0082832 | A1 * | 3/2015 | Mencagli | A44B 1/32 2/244 |
| 2015/0089976 | A1 * | 4/2015 | Alulis | A44C 25/002 63/40 |
| 2015/0101366 | A1 * | 4/2015 | Liao | G04B 45/0069 63/40 |
| 2015/0282575 | A1 * | 10/2015 | Smith | A44C 17/0208 63/3 |
| 2016/0037882 | A1 * | 2/2016 | Heinz | A44C 9/003 63/15.7 |
| 2016/0183645 | A1 * | 6/2016 | Drouhard | A44C 17/0216 63/15 |
| 2017/0020246 | A1 * | 1/2017 | Bonoli | A44C 17/0216 |
| 2017/0035161 | A1 * | 2/2017 | Malo | A44C 9/003 |
| 2017/0332746 | A1 * | 11/2017 | Krainz | A44C 9/0023 |
| 2018/0027933 | A1 * | 2/2018 | Mollier | A44C 17/0216 |
| 2018/0343993 | A1 * | 12/2018 | Derrig | A44C 27/006 |
| 2019/0174886 | A1 * | 6/2019 | Song | C22C 29/08 |
| 2019/0239603 | A1 * | 8/2019 | Fogel | A44C 9/00 |
| 2020/0146405 | A1 * | 5/2020 | Hall | A44C 25/007 |
| 2021/0010643 | A1 * | 1/2021 | Song | F17C 13/00 |
| 2022/0218079 | A1 * | 7/2022 | Beck | A44C 17/0208 |
| 2022/0287419 | A1 * | 9/2022 | Crowley | A44C 5/0084 |
| 2023/0255329 | A1 * | 8/2023 | Jawson | A44C 17/0208 63/40 |
| 2023/0346086 | A1 * | 11/2023 | Ostanin | A44C 17/02 |
| 2024/0016264 | A1 * | 1/2024 | Galanakis | A44C 17/0216 |
| 2024/0138534 | A1 * | 5/2024 | Brown | A44C 17/0208 |
| 2024/0398076 | A1 * | 12/2024 | Hofmann | A44C 17/0208 |

FOREIGN PATENT DOCUMENTS

| | | | | |
|---|---|---|---|---|
| CN | 204763779 | U * | 11/2015 | |
| CN | 204812431 | U * | 12/2015 | |
| CN | 111084471 | A | 5/2020 | |
| CN | 113229579 | A * | 8/2021 | A44C 9/0023 |
| CN | 113317602 | A * | 8/2021 | A44C 9/02 |
| CN | 214156414 | U * | 9/2021 | |
| CN | 214432324 | U * | 10/2021 | |
| CN | 113827007 | A * | 12/2021 | A44C 25/00 |
| CN | 216165685 | U | 4/2022 | |
| DE | 19757143 | A1 * | 6/1999 | A44C 17/0216 |
| DE | 202008013898 | U1 * | 1/2009 | A44C 25/001 |
| DE | 202013000291 | U1 * | 4/2013 | A44C 9/003 |
| EP | 2476335 | A1 * | 7/2012 | A44C 9/003 |
| EP | 4311450 | A1 * | 1/2024 | A44C 17/0208 |
| JP | 2006304927 | A * | 11/2006 | |
| JP | 3132887 | U * | 6/2007 | |
| KR | 100827274 | B1 * | 5/2008 | A44C 9/0023 |
| KR | 20200064521 | A * | 6/2020 | A44C 15/005 |

OTHER PUBLICATIONS

Written Opinion of the International Search Authority in corresponding International application No. PCT/CN2021/142383, mailed Jun. 27, 2022 (7 pages).

CNIPA, Office Action issued for Chinese Application No. 202111313500.7, mailed Jul. 8, 2025 (13 pages).

* cited by examiner

JEWELRY ITEM

TECHNICAL FIELD

The present disclosure relates to a jewelry item.

BACKGROUND

Ring-shaped decorative elements for wearing, such as rings, chains, and pendants, are made of precious metals or gems. A conventional ring-shaped decorative element is generally of a simple structure, which mainly consists of a ring body and a decorative portion arranged on the ring body. A structure of the conventional ring-shaped decorative element is relatively homogeneous. A person is unable to combine a number of ring-shaped decorative elements at will to distinguish the ring-shaped decorative elements from other decorative elements, which is far from meeting needs of people who wants to show themselves on the decorative elements they wear. That is, the decorative elements are impossible to meet a demand for personalization.

With development of society, some decorative elements with replaceable decorative bodies come into being. For example, the Chinese application No. 202020117069.3, titled "RING" (as shown in FIGS. 1 and 2), discloses a ring. The ring comprises a ring base 1, a collet 2, and a gem 3. The ring base 1 comprises a ring base body 10 defining a notch and a collet mounting portion 12 arranged on the notch. The collet mounting portion 12 is connected with the ring base body 10. The collet mounting portion 12 defines a fixed hole 121 fixing the collet. The collet 2 comprises a main collet body 21 and a secondary collet body 22. The main collet body 21 comprises an internal threaded mounting column 20 with an internal threaded hole 201. The internal threaded mounting column 20 is threaded into the secondary collet body 22 from top to bottom. When the collet (the decorative body) is mounted, the internal threaded mounting column 20 of the main collet body 21 is inserted into the secondary collet body 22. Then the internal threaded mounting column 20 connected with the secondary collet body 22 is inserted into the fixed hole 121 of the ring base body 10. A bolt 14 is inserted from an inner wall of the ring base body 10 into the internal threaded mounting column 20 of the main collet body 21, so the collet is locked to the ring base body 10. In the Chinese application, different main collet bodies 21 and different secondary collet bodies 22 are selected to connect with the ring base body 10 to from the ring by a user as desired. Therefore, the user is able to match different styles of rings to the outfit, a bag, and colors of the outfit they are wearing. The ring of the Chinese application solves a limitation that an appearance of a conventional ring is unable to be changed, so the user is able to wear the ring with different appearances for a small amount of money, which greatly improves user experience and satisfaction.

However, the Chinese application still has some defects. Firstly, an assembly of the ring is time consuming and difficult. Since a diameter of the ring is small, the bolt used is also very small, the user needs to keep the collect aligned with the fixed hole all the time, and then it is very difficult to insert the bolt into the internal threaded mounting column. That is, the bolt is difficult to align, and the fixed hole is difficult to align. Secondly, the bolt is easy to loosen and fall off, resulting in the decorative body easy to fall off and lose. Thirdly, the ring base body adopts a conventional structure and is unable to be changed according to the user's needs.

The ring has a single structure, cannot meet the user's needs, and reduces the user experience and satisfaction.

SUMMARY

In view of above deficiencies in the prior art, the present disclosure provides a jewelry item with freely combinable decorative elements. Compared with the prior art, the jewelry item is more decorative, is faster and simpler for assembly, and has a simpler and more ingenious structure, which reduces assembly difficulty, makes the assembly stable and reliable, and improves user experience.

To solve the above deficiencies, the present disclose provides a jewelry item. The jewelry item comprises an inner ring base, an inner ring arranged on the inner ring base, and a decorative body. A slot is provided on an outer surface of the inner ring base. The inner ring defines a through hole at a position corresponding to the slot. The decorative body comprises a mounting column. The mounting column passes through the through hole and is limited in the slot.

In the jewelry item with the freely combinable decorative elements of the present disclosure, a triple compound limiting locking structure is configured to limit the decorative body on the inner ring base, which completely prevents the decorative body from separating from the inner ring base. The limiting locking structure is simple and ingenious that it can be assembled and disassembled with hands only without use of any tools.

Compared with the prior art, the jewelry item with the freely combinable decorative elements of the present disclosure is more convenient for the user to assemble and disassemble, which greatly improves assembly time and efficiency, avoids a problem of falling off and losing of components due to bolt loosening, ensures safety of the user's property, and improves the user's experience and satisfaction. When assembly, the user is able to accurately and fast mount the first outer ring, the second outer ring, the inner ring, and the decorative body on the inner ring base, which solves a problem that the bolt is broken or slipped due to the use is unable to see the fixed hole of a conventional ring. The first outer ring, the second outer ring, the inner ring, and the decorative body are detachably arranged on an outer surface of the inner ring base. The first outer ring, the second outer ring, the inner ring, and the decorative body are replaceable, so the user is able to assemble the jewelry item as desired. According to different occasions and different clothes, the user is able to replace the first outer ring, the second outer ring, the inner ring, and the decorative body. Therefore, with the least cost, the jewelry item has many different forms due to different combinations of the decorative elements (the first outer ring, the second outer ring, the inner ring, and the decorative body), which improves the user's experience and satisfaction, and meets the user's need of changing an appearance of the jewelry item. In addition, in the jewelry item of the present disclosure, each first locking piece, each first locking portion, each first strip-shaped opening, each second locking piece, each second locking portion, and each second strip-shaped opening are integrally formed with the inner ring base, which increases consistency and stability of the jewelry item and increases the service life. Each first locking piece and each second locking piece are not deteriorate or fall off with increase of use time, which reduces an after-sale maintenance rate and brings convenience to both customers and businesses.

DETAILED DESCRIPTION

Figure 1:
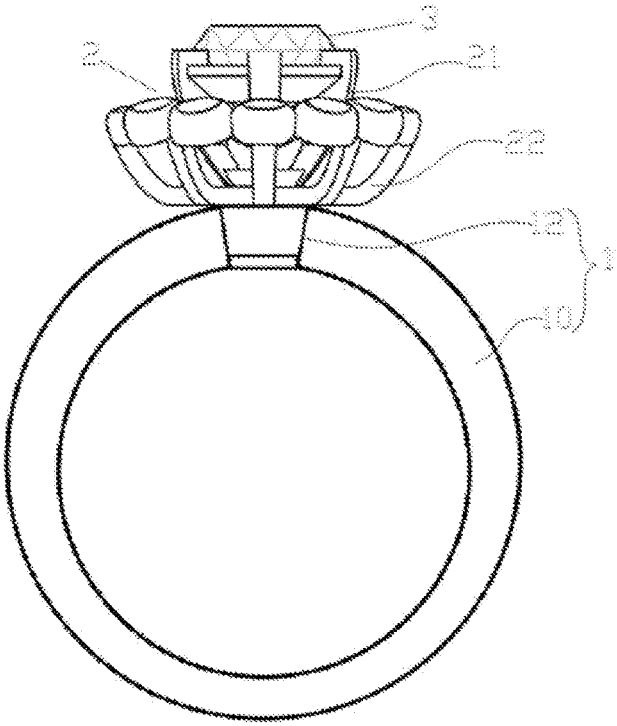
FIG. 1 PRIOR ART
FIG. 1 is a schematic diagrams of a ring in the prior art.
Figure 2:
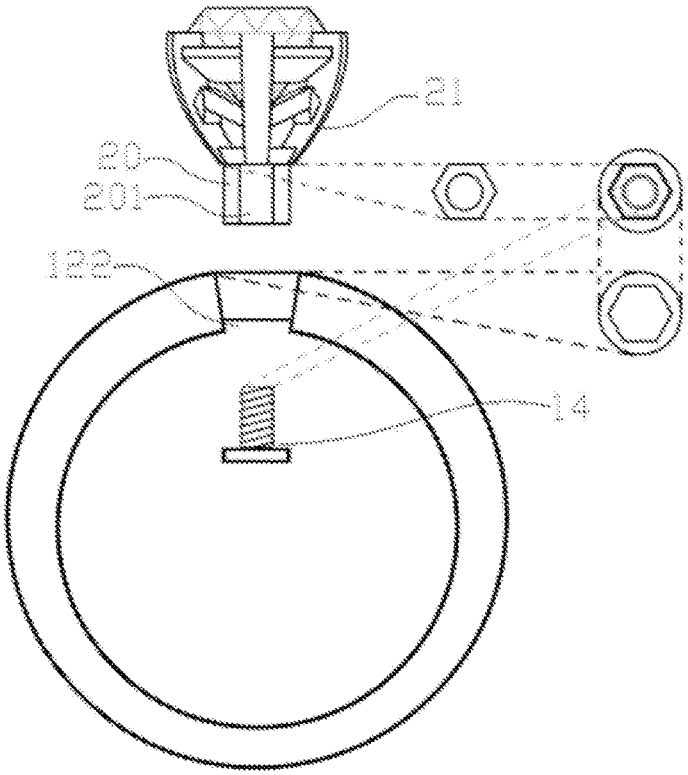
FIG. 2 PRIOR ART
FIG. 2 is an exploded schematic diagrams of the ring shown in FIG. 1.
Figure 3:
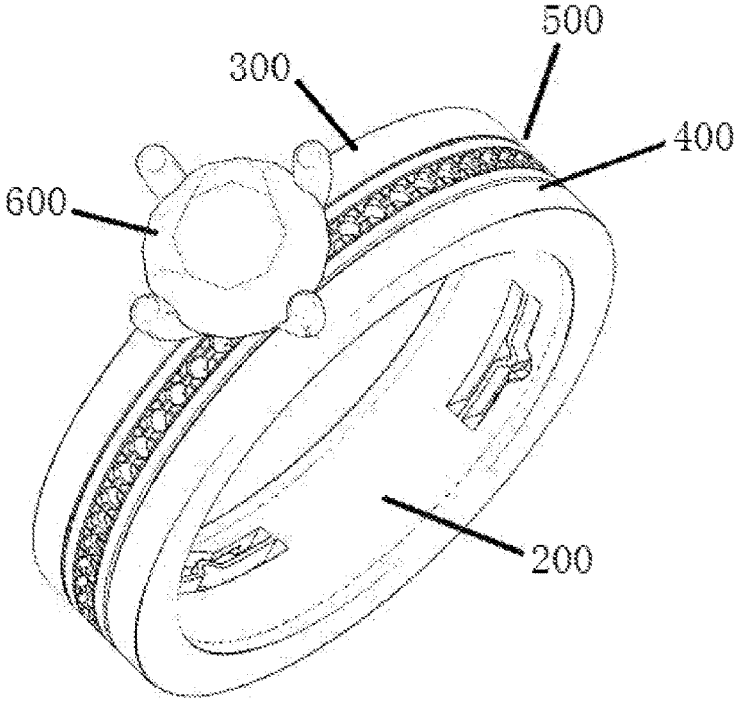
FIG. 3 is a schematic diagram of a jewelry item according to one embodiment of the present disclosure.
Figure 4:
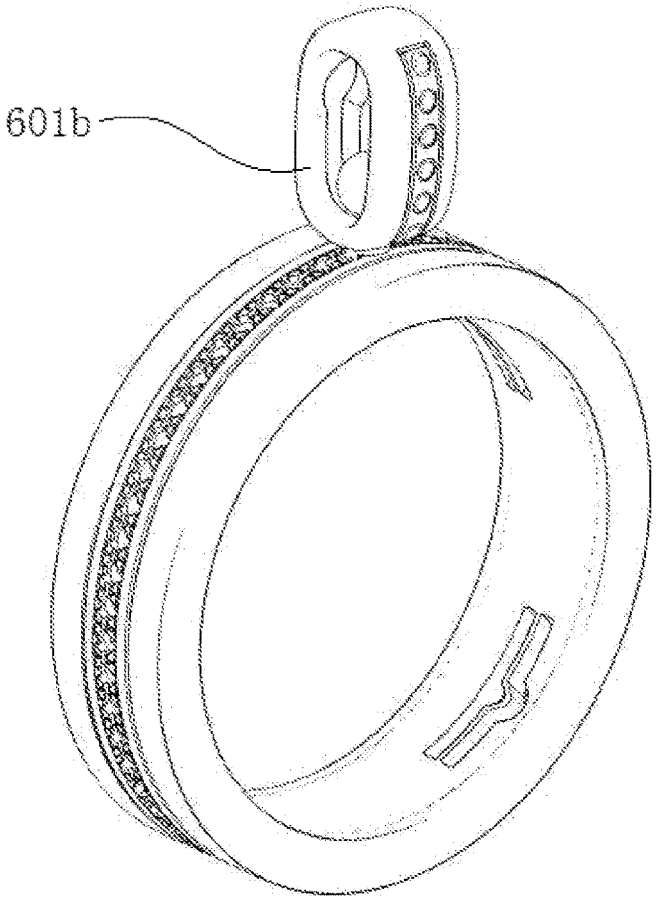
FIG. 4 is a schematic diagram of the jewelry item according to one embodiment of the present disclosure.
Figure 5:
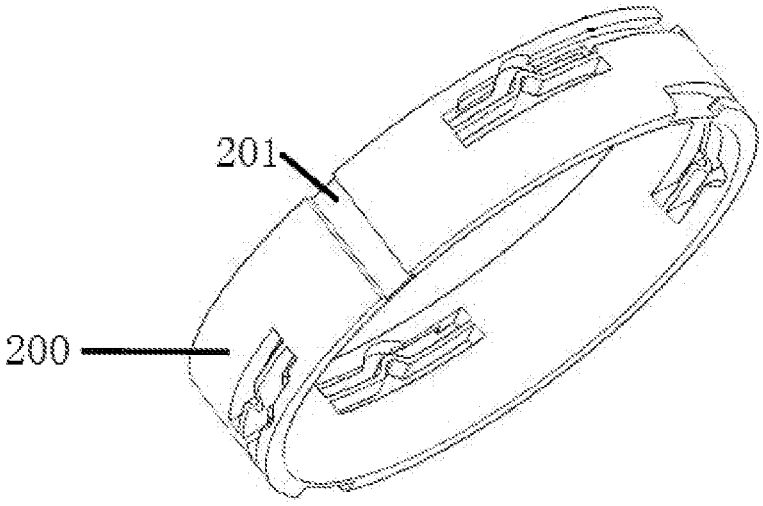
FIG. 5 is a schematic diagram of an inner ring base of the jewelry item according to one embodiment of the present disclosure.
Figure 6:
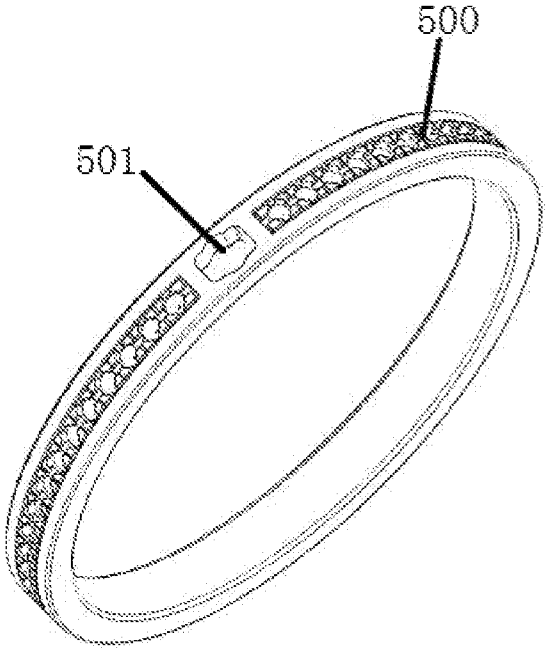
FIG. 6 is a schematic diagram of an inner ring of the jewelry item according to one embodiment of the present disclosure.
Figure 7:
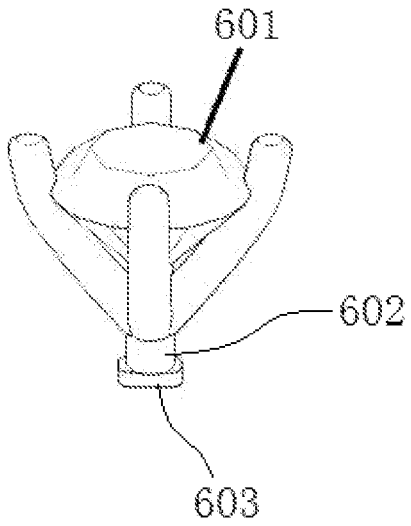
FIG. 7 is a schematic diagram of a decorative body of the jewelry item according to one embodiment of the present disclosure.
Figure 8:
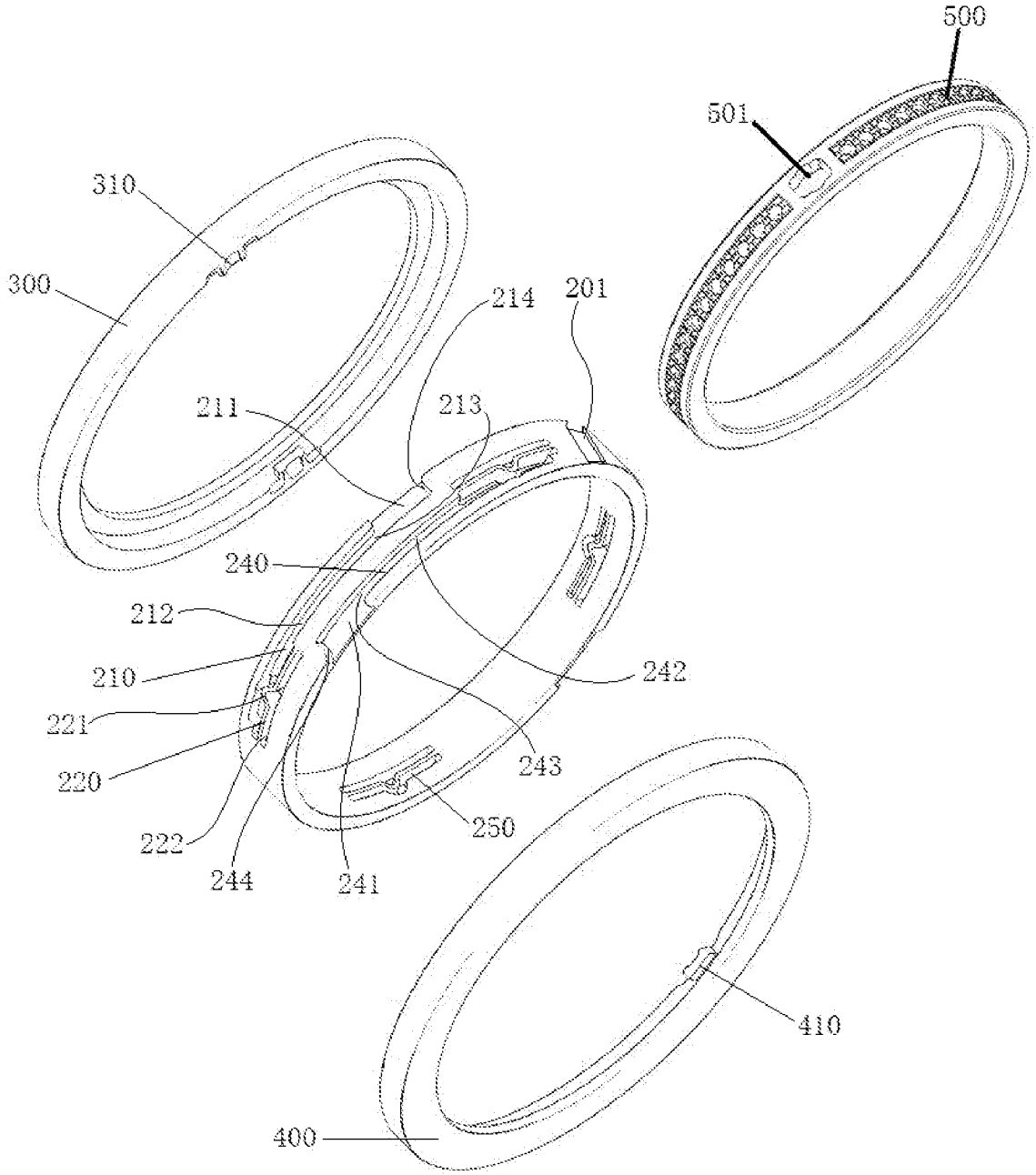
FIG. 8 is an exploded schematic diagram of the jewelry item according to one embodiment of the present disclosure.
Figure 9:
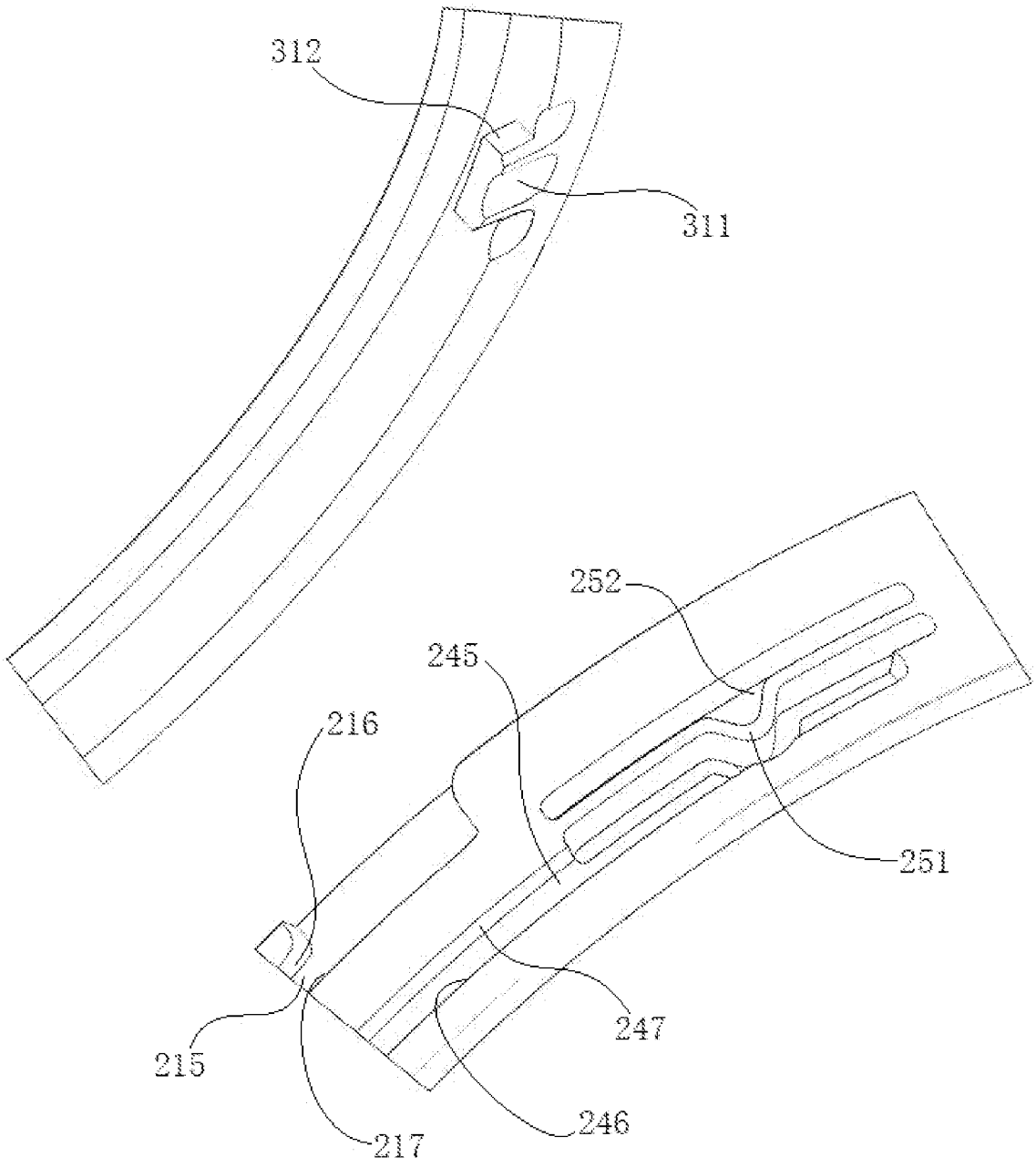
FIG. 9 is a partial schematic diagram of the jewelry item of the present disclosure.

As shown in FIGS. 3 and 9, in one optional embodiment, the present disclosure provides a jewelry item. The jewelry item comprises an inner ring base 200, a first outer ring 300 arranged on a first end of the inner ring base 200, a second outer ring 400 arranged on a second end of the inner ring base 200, and an inner ring 500 arranged on the inner ring base 200. The inner ring 500 is arranged between the first outer ring 300 and the second outer ring 400. The first outer ring 300 and the second outer ring 400 are respectively snapped on the first end and the second end of the inner ring 200. After the first outer ring 300, the second outer ring 400, and the inner ring 500 are mounted on the inner ring base 200, the first outer ring 300, the second outer ring 400, and the inner ring 500 fully cover the inner ring base 200 from an axial direction of the inner ring base 200, so that the inner ring 200 base is shielded by the first outer ring 300, the second outer ring 400, and the inner ring 500. From a point of view of cost saving, the inner ring base 200 may be made of metal with characteristics of lightweight, antioxidant, and low cost, such as stainless steel, silver, or other metal materials. The first outer ring 300 and the second outer ring 400 may be made of gold, 18K gold, platinum, or other precious metals.

A display portion of the first outer ring 300, a display portion of the second outer ring 400, and a display portion of the inner ring 500 are of diverse and aesthetic designs. For example, the display portion of the first outer ring 300, the display portion of the second outer ring 400, and the display portion of the inner ring 500 may be inlaid with gems, diamonds, jade, and other components. Alternatively, the display portion of the first outer ring 300, the display portion of the second outer ring 400, and the display portion of the inner ring 500 may adopt a curved design, which brings beautiful experience and feeling to a user. The display portion of the first outer ring 300 is usually an outer surface of the first outer ring 300 or an end surface of the first outer ring 300 that can be noticed, the display portion of the second outer ring 400 is usually an outer surface of the second outer ring 400 or an end surface of the second outer ring 300 that can be noticed, and the display portion of the inner ring 500 is an outer surface of the inner ring 500.

In another embodiment, the inner ring may be arranged on an outer periphery of the inner ring base 200 and there are no first outer ring and the second outer ring arranged at two ends of the inner ring base 200. In the embodiment, an axial length of the inner ring is equal to an axial length of the inner ring base. That is, the inner ring is completely covered on an outer periphery of the inner ring base.

A size and the number of the inner ring 500 are set according to an actual need. Optionally, a thickness of the first outer ring 300, a thickness of the second outer ring 400, and a thickness of the inner ring 500 are matched with each other, so that the outer surface of the first outer ring 300, the outer surface of the second outer ring 400, and the outer surface of the inner ring 500 are located on a same arc surface. A shape and a structure of the first outer ring 300 are same as a shape and a structure of the second outer ring 400, which saves cost of mold opening and increases integrity and consistency of the jewelry item. An outer end of the first outer ring 300 and an outer end of the second outer ring 400 respectively corresponding to positions of the two ends of the inner ring base 200 defines retaining edges shielding end surfaces of the inner ring base 200 (not shown in the drawings). Widths of the retaining edges are adapted to a thickness of the inner ring base 200. Thus, after the first outer ring 300 and the second outer ring 400 are snapped on the inner ring base 200, the retaining edges shield the two end surfaces of the inner ring base 200.

In the embodiment, a slot 201 is provided on an outer surface of the inner ring base 200. The inner ring 500 defines a through hole 501 at a position corresponding to the slot 201. The jewelry item further comprises a decorative body 600. The decorative body 600 comprises a mounting column 602. The mounting column 602 passes through the through hole 501 and is limited in the slot 201. That is, the decorative body 600 comprises a decorative main body 601 and a mounting column 602 arranged on a lower end surface (a surface of the decorative main body 601 towards the inner ring 500 and the inner ring base 200) of the decorative main body 601. A locking block 603 is arranged on a lower end of the mounting column 602. The decorative body 600 is selected from a flower-shaped clasp 601, a melon-seed-shaped clasp 601*b*, an earring clasp, a bracelet clasp, a brooch clasp, or any object with a decorative effect. The mounting column 602 is arranged on the lower end of each of these decorative objects.

The slot 201 is a U-shaped slot with a U-shaped cross section. The outer surface of the inner ring base 200 radially recessed to form the slot 201. The slot 201 runs through the inner ring base 200 along the axial direction of the inner ring base 200. It should be noted that "the slot 201 runs through the inner ring base 200 along the axial direction of the inner ring base 200" means that the slot 201 runs through the inner ring base 200 from the first end of the inner ring base 200 or the slot 201 runs through the inner ring base 200 from both the first end and the second end of the inner ring base 200. Namely, an axial length of the slot 201 is equal to an axial length of the inner ring base 200, so that the mounting column 602 is inserted into the slot 201 from the first end of the inner ring base 200 or the mounting column 602 is inserted into the slot 201 from the second end of the inner ring base 200.

The through hole 501 is defined on a position of the inner ring 500 corresponding to the clot 201. The through hole 501 is a strip-shaped through hole 501. The strip-shaped through hole 501 cooperates with the slot 201 to limit the mounting column 602. A length of the strip-shaped through hole 501 is greater than a width of the slot 201. The locking block 603 is integrally arranged on the lower end of the mounting column 602. A length of the locking block 603 is matched with the length of the strip-shaped through hole 501. A width of the locking block 603 is matched with the width of the slot 201. When mounting the decorative body 600, the locking block 603 is inserted into the strip-shaped through hole 501 and is rotated 90 degrees, so a width direction of the locking block 603 is consistent with a width direction of the slot 201. Then the locking block 603 is pushed into the slot 201. In this way, a length direction of the strip-shaped through hole 501 is perpendicular to a length direction of the slot 201. When the locking block 603 is inserted into the strip-shaped through hole 501 of the inner ring 500, a length direction of the locking block 603 is consistent with the length direction of the strip-shaped through hole 501, so the locking block 603 smoothly passes through the strip-shaped through hole 501 and is located on one side of the slot 201. Then the locking block 603 is rotated, so the length direction of the locking block 603 is consistent with the length direction of the slot 201 and the locking block 603 is pushed into the slot 21 from a first end or a second end of the slot 201. The locking block 603 connected with the inner ring 500 is sleeved outside the inner ring base 200 to form a first limit of multiple limits of the jewelry item. When mounted in place, because the locking block 603 is limited in the slot 201, the locking block 603 is unable to be horizontally rotated after being limited, which forms a second limit of the multiple limits of the jewelry item. Meanwhile, the inner ring 500 limits the locking block 603 in a radial direction, so that the locking block 603 is prevented from separating from the slot 201, which forms a third limit of the multiple limits of the jewelry item. The first outer ring 300 is locked on the first end of the inner ring base 200 to prevent the locking block 603 from moving toward the first end of the inner ring base 200. The second outer ring 400 is locked on the second end of the inner ring base 200 to prevent the locking block 603 from moving toward the second end of the inner ring base 200. The first outer ring 300 and the second outer ring 400 limit the locking block 603 in the axial direction. In summary, arrangements and matching structures of the slot 201, the strip-shaped through hole 501, and the locking block 603 in the present disclosure are simple and ingenious, which forms multiple limit structures, effectively and firmly locks the limit structures, is completely disassembled and assembled by hand without any tools, and is simple and fast to assemble. By the above limit structures and by configurations of the width of the slot 201, the length of the strip-shaped through hole 501, and the length and the width of the locking block 603, the locking block 603 is quickly assembled and firmly locked in the slot 201.

In one optional embodiment, when the jewelry item with freely combinable decorative elements only comprises the inner ring base 200 and the inner ring 500 arranged on the inner ring 200. The thickness of the locking block 603 is slightly greater than a depth of the slot 201, i.e. the locking block 603 extends slightly outside the slot 201. A distance between the locking block 603 and the decorative body 601 matches a thickness of the inner ring 500, so that when the inner ring 500 is arranged on the inner ring base 200, the thickness of the locking block 603 allows the inner ring 500 to be pressed against the inner ring base 200 and the locking block 603, which effectively prevents the locking block 602 from displacing in the axial direction.

Furthermore, the first outer ring 300 is locked on the first end of the inner ring base 200. Specifically, the first end of the inner ring base 200 defines at least one first guiding channel 210. At least one first locking piece 220 integrally formed on the inner ring base 200 is arranged on the first end of the inner ring base 200. The at least one first locking piece 220 comprises a first locking portion arranged in a tail portion of the at least one first guiding channel 210. The first outer ring 300 comprises at least one first fastener corresponding to the at least one first locking portion. The at least one first fastener is inserted into the tail portion of the at least one first guiding channel 210 and the at least one first fastener is locked with the at least one locking portion. Each first guiding channel 210 and each first locking piece form a first locking assembly. A plurality of first locking assemblies is provided on the inner ring base 200 at even intervals along a circumferential direction of the inner ring base 200. The first outer ring 300 comprises a plurality of first fasteners 310 one-to-one corresponding to the plurality of first locking assemblies. In the present disclosure, the inner ring base 200 comprises three first locking assemblies and the first outer ring 300 comprises three first fasteners 310 one-to-one corresponding to the three first locking assemblies. By such arrangements, a screwing stroke of the first outer ring 300 is reduced, so that the first outer ring 300 is quickly locked on the inner ring base 200. Further, the first outer ring 300 is stably and firmly locked on the inner ring base 200, which has a good locking effect. Each first guiding channel 210 comprises a first inlet 211 and a first guiding through groove 212 extending from the first inlet 211 along the circumferential direction of the inner ring base 200. Each first inlet 211 allows a corresponding first fastener to insert into along the axial direction of the inner ring base 200. Each first inlet 211 and each first guiding through groove 212 run through the inner ring base 200 along the radial direction of the inner ring base 200, so each first guiding channel 210 runs through the inner ring base 200 along the radial direction of the inner ring base 200. The tail portion of each first guiding channel 210 is defined as one end of a corresponding first guiding through groove 212 away from a corresponding first inlet 211.

An end surface of the first end of the inner ring 200 facing the second end of the inner ring 200 is recessed to form each first inlet 211. One side of a bottom portion of each first inlet 211 toward a corresponding first guide through groove 212 forms a first opening 213 communicated with a corresponding first guiding through groove 212. One side face of each first inlet 211 away from a corresponding first opening 213 forms a first guiding side face 214. A bottom portion of each first inlet 211 inclines and extends toward the first end of the inner ring base to away from a corresponding first guiding through groove 212 to form each first guiding side face 214, so an aperture of each first inlet 211 is gradually reduced toward a direction of the bottom portion of each first inlet 211. It is noted that even the bottom portion of each first inlet having a smallest aperture is matched with a size of each first fastener. Thus, it is ensured that each first fastener 310 is smoothly inserted into a corresponding first inlet from the bottom portion of a corresponding first inlet. Therefore, each first fastener 310 is inserted into one end of the corresponding first guiding through groove 212.

Each first guiding through groove 212 comprises a first groove bottom portion 215 (That is a first bottom wall of each first guiding channel 210) recessed in the outer surface of the inner ring base 200, a first guiding sidewall 216 (that is, the first guiding sidewall of each first guiding channel 210) close to the first end of the inner ring base 200, and a second guiding sidewall 217 (that is, the second guiding sidewall of each first guiding channel 210) opposite to the first guiding sidewall 216. Each first locking piece 220 is arranged between a corresponding first guiding channel 210 and a corresponding second guiding channel 240 and is close to the corresponding first guiding channel 210. One side of each first locking piece 220 facing a corresponding first guiding channel 210 forms the second guiding sidewall 217 arranged in the tail portion of each first guiding channel 210. It is understood that each first locking piece 220 may also be formed at the first end of the inner ring base 200. That is, each first locking piece 220 is arranged between a first end surface of the inner ring base 200 and a corresponding first guiding channel 210. A distance between each first elastic hook and a corresponding second guiding sidewall is less than a width of each first guiding channel 210.

Each first locking piece 220 is integrally formed at the first end of the inner ring base 200. Specifically, the first end of the inner ring base 200 defines first strip-shaped openings 222 one-to-one parallel to the tail portion of a corresponding first guiding channel 210. A portion between each first strip-shaped opening and the tail portion of the corresponding first guiding channel 210 forms one first locking piece 220. One side of each first locking piece 220 toward the corresponding first guiding channel 210 forms each first guiding sidewall 216 at one end of the corresponding first guiding channel 210. A middle portion of each first locking piece 220 extends into the corresponding first guiding channel 210 to form each first locking portion. In actual production, each first locking piece 220 and the corresponding first locking piece and the corresponding first strip-shaped opening 222 are integrally formed by precision computer numerical control (CNC) machining. When each first strip-shaped opening 222 is formed after the precision CNC machining, a portion between each first strip-shaped opening 222 and the tail portion of the corresponding first guiding channel 210 forms each first locking piece 220. Each first locking piece 220 is a strip-shaped structure matched with a length of a corresponding first strip-shaped opening 222. The middle portion of each first locking piece 220 extends into the corresponding first guiding channel 210 to form a V-shaped first elastic hook 221. A distance between each first elastic hook 221 and a corresponding first guiding sidewall 216 is less than a width of the first guiding channel 210. Each first locking piece 220 and the inner ring base are integrally formed, which has advantages of good solidity, good stability, small deformation, and good locking strength. Each first strip-shaped opening 222 forms an elastic deformation space for a corresponding first locking piece to ensure elasticity of a corresponding first locking portion.

The second end of the inner ring base 200 defines at least one second guiding channel 240. At least one second locking piece 250 integrally formed on the inner ring base 200 is arranged on the second end of the inner ring base 200. The at least one second locking piece 250 comprises a second locking portion arranged in a tail portion of the at least one second guiding channel 240. The second outer ring 400 comprises at least one second fastener corresponding to the at least one locking portion. The at least one second fastener is inserted into the tail portion of the at least one second guiding channel 240 and the at least one second fastener is locked with the at least one second locking portion. Each second guiding channel 240 and each second locking piece form a second locking assembly. A plurality of second locking assemblies is provided on the inner ring base 200 at even intervals along the circumferential direction of the inner ring base 200. The second outer ring 400 comprises a plurality of second fasteners 410 one-to-one corresponding to the plurality of second locking assemblies. In the present disclosure, the inner ring base 200 comprises three second locking assemblies and the second outer ring 400 comprises three second fasteners 410 one-to-one corresponding to the three second locking assemblies. By such arrangements, a screwing stroke of the second outer ring 400 is reduced, so that the second outer ring 400 is quickly locked on the inner ring base 200. Further, the second outer ring 400 is stably and firmly locked on the inner ring base 200, which has a good locking effect.

Furthermore, the second outer ring 400 is locked on the second end of the inner ring base 200. Specifically, each second guiding channel 240 comprises a second inlet 241 and a second guiding through groove 242 extending from the second inlet 241 along the circumferential direction of the inner ring base 200. Each second inlet 241 allows a corresponding second fastener to insert into along the axial direction of the inner ring base 200. Each second inlet 241 and each second guiding through groove 242 run through the inner ring base 200 along the radial direction of the inner ring base 200, so each second guiding channel 240 runs through the inner ring base 200 along the radial direction of the inner ring base 200. The tail portion of each second guiding channel 240 is defined as one end of a corresponding second guiding through groove 242 away from a corresponding second inlet 241.

An end surface of the second end of the inner ring 200 facing the second end of the inner ring 200 is recessed to form each second inlet 241. One side of a bottom portion of each second inlet 241 toward a corresponding second guide through groove 242 forms a second opening 243 communicated with a corresponding second guiding through groove 242, One side face of each second inlet 241 away from a corresponding second opening 243 forms a second guiding side face 244. A bottom portion of each second inlet 241 inclines and extends toward the second end of the inner ring base to away from a corresponding second guiding through groove 242 to form each second guiding side face 244, so an aperture of each second inlet 241 is gradually reduced toward a direction of the bottom portion of each second inlet 241. It is noted that even the bottom portion of each second inlet having a smallest aperture is matched with a size of each second fastener. Thus, it is ensured that each second fastener 410 is smoothly inserted into a corresponding second inlet from the bottom portion of a corresponding second inlet. Therefore, each second fastener 410 is inserted into one end of the corresponding second guiding through groove 242.

Each second guiding through groove 242 comprises a second groove bottom portion 245 (That is a second bottom wall of each second guiding channel 240) recessed in the outer surface of the inner ring base 200, a third guiding sidewall 246 (that is, the third guiding sidewall of each second guiding channel 240) close to the second end of the inner ring base 200, and a fourth guiding sidewall 247 (that is, the fourth guiding sidewall of each second guiding channel 240) opposite to the second guiding sidewall 246. Each second locking piece 250 is arranged between a corresponding second guiding channel 240 and a corresponding first guiding channel 210 and is close to the corresponding second guiding channel 240. One side of each second locking piece 250 facing a corresponding second guiding channel 240 forms the fourth guiding sidewall 247 arranged in the tail portion of each second guiding channel 240. It is understood that each second locking piece 250 may also be formed at the second end of the inner ring base 200. That is, each second locking piece 250 is arranged between a second end surface of the inner ring base 200 and a corresponding second guiding channel 240. A distance between each second elastic hook and a corresponding fourth guiding sidewall 247 is less than a width of each second guiding channel 240.

Each second locking piece 250 is integrally formed at the second end of the inner ring base 200. Specifically, the second end of the inner ring base 200 defines second strip-shaped openings 252 one-to-one parallel to the tail portion of a corresponding second guiding channel 240. A portion between each second strip-shaped opening and the tail portion of the corresponding second guiding channel 240 forms one second locking piece 250. One side of each second locking piece 250 toward the corresponding second guiding channel 240 forms each third guiding sidewall 246 at one end of the corresponding second guiding channel 240.

A middle portion of each second locking piece 250 extends into the corresponding second guiding channel 240 to form each second locking portion. In actual production, each second locking piece 250 and the corresponding second locking piece and the corresponding second strip-shaped opening 252 are integrally formed by the precision CNC machining. When each second strip-shaped opening 252 is formed after the precision CNC machining, a portion between each second strip-shaped opening 252 and the tail portion of the corresponding second guiding channel 240 forms each second locking piece 250. Each second locking piece 250 is a strip-shaped structure matched with a length of a corresponding second strip-shaped opening 252. The middle portion of each second locking piece 250 extends into the corresponding second guiding channel 240 to form a V-shaped second elastic hook 251. A distance between each second elastic hook 251 and a corresponding second guiding sidewall 246 is less than a width of the second guiding channel 240. Each second locking piece 250 and the inner ring base are integrally formed, which has advantages of good solidity, good stability, small deformation, and good locking strength. Each second strip-shaped opening 252 forms an elastic deformation space for a corresponding second locking piece to ensure elasticity of a corresponding second locking portion.

The shape and the structure of the first outer ring 300 are the same as or are similar to the shape and the structure of the second outer ring 400, so the first outer ring 300 and the second outer ring 400 are able to be molded by a same mold. Each first fastener 310 is arranged on a first end surface (inner end surface) of one end of the first outer ring 300 facing the second outer ring 400. Each first fastener 310 comprises a first snapping portion. The inner end surface of the first outer ring 300 is radially extended inward to form each first snapping portion. Each first snapping portion comprises a first snapping teeth 311 corresponding to a position of each first elastic hook 221 (in the embodiment, three first snapping tooth are provided). Each first snapping teeth 311 has a concave arc shape matched with a shape of each first elastic hook 221, and a space is formed between every two adjacent first snapping tooth 311. A depth of each first snapping portion is matched with a depth of each first guiding through groove 212. Each first snapping portion comprises first protruding portions 312 protruding toward an outer end surface of the first outer ring 300. A thickness of each of the first protruding portions 312 is matched with a distance between the first guiding sidewall and the second guiding sidewall of each first guiding through groove 212. The thickness of each of the first protruding portions 312 is slightly greater than a first pressing gap 207. Each second fastener 410 is arranged on a second end surface (inner end surface) of one end of the second outer ring 400 facing the second outer ring 400. Each second fastener 410 comprises a second snapping portion. The inner end surface of the second outer ring 400 is radially extended inward to form each second snapping portion. Each second snapping portion comprises a second snapping teeth corresponding to a position of each second elastic hook (in the embodiment, three second snapping tooth are provided). Each second snapping teeth has a concave arc shape matched with a shape of each second elastic hook, and a space is formed between every two adjacent second snapping tooth. A depth of each second snapping portion is matched with a depth of each second guiding through groove. Each second snapping portion comprises second protruding portions protruding toward an outer end surface of the second outer ring 400. A thickness of each of the second protruding portions is matched with a distance between the third guiding sidewall and the fourth guiding sidewall of each second guiding through groove 242. The thickness of each of the second protruding portions is slightly greater than the second pressing gap.

Optionally, the jewelry item of the present disclosure further comprises the inner ring 500 arranged on the inner ring base 200 and arranged between the first outer ring 300 and the second outer ring 400.

When the jewelry item of the present disclosure is assembled, firstly, the inner ring 500 connected with the decorative body 600 is arranged on the inner ring base 200. Specifically, the length direction of the locking block 603 is made to be consistent with the length direction of the strip-shaped through hole 501, so that the locking block 603 smoothly passes through the strip-shaped through hole 501 and then is located on the one side of the slot 201. Then the locking block 603 is rotated by 90 degrees, so that the length direction of the locking block 603 is consistent with the length direction of the clot 201. The locking block 603 is pushed into the slot 201 from the first end or the second end of the slot 201, therefore, the locking block 603 connected with the inner ring 500 is arranged on the inner rig base 200. Secondly, the first outer ring 300 is assembled. Specifically, each first fastener 310 of the first outer ring 300 is aligned with each first inlet 211 and is mounted in each first inlet 211 along the axial direction of the inner ring base 200. Since the aperture of each first inlet 211 is large, it is convenient for each first fastener 310 to be mounted. During a mounting process of each first inlet 211, the first guiding side face 214 of each first inlet 211 plays a guiding role due to an inclined structure thereof. Thus, each first fastener 310 is quickly mounted into the bottom portion of each first inlet 211. Further, each first guiding side face 214 is gradually inclined toward a corresponding first guiding through groove 212, so that each first fastener 310 unaffectedly, smoothly, and quickly approaches a corresponding first opening 213 at the bottom portion of the corresponding first inlet 211, which further makes each first fastener 310 to be located at the corresponding first opening 213 when each first fastener reaches the bottom portion of the corresponding first inlet 211. Thirdly, the second outer ring 400 is assembly in a same way as the first outer ring 300.

In the jewelry item of the present disclosure, the slot 201, the strip-shaped through hole, the locking block, and other matching structures, having simple and ingenious structures and forming the multiple limits of the jewelry item, effectively and firmly lock the limit structures and are able to be disassembled and assembled completely with bare hands without any tools during assembly, which makes the assembly easy and fast. By adopting the above limit structures, the width of the slot 201, the length of the strip-shaped through hole 501, and the length and width of the locking block 603 are cleverly determined, so that the locking block 603 is quickly fitted and firmly locked in the slot 201. Each first locking piece enables the first fastener 310 to smoothly and quickly enter into the corresponding first guiding through groove 212 from the corresponding first inlet 211 without getting stuck. The size of each first guiding through groove 212 is matched with the size of each first fastener 310. Each first fastener 310 is not separated from the corresponding first guiding through groove 212 after entering the corresponding first guiding through groove 212. When each first fastener 310 is inserted into the tail portion of the corresponding first guiding channel 210, the corresponding first elastic hook 221 is compressed by the first fastener 310, causing a slight outward elastic deformation, which makes the first pressing gap greater, and the first snapping teeth of each first fastener 310 is engaged with the corresponding first elastic hook 221. A crisp, rhythmic and pleasing sound is generated during this action, which increase a sense of experience of the user. A specific structural feature of the first pressing gap makes each first fastener 310 to be entered into the corresponding first locking piece 220 under the external force. Even if it encounters a certain touch during a wearing process, the first pressing gap effectively prevents each first fastener 310 from separating from the corresponding first locking piece 220. An assembly of the second outer ring 400 is same as the assembly of the first outer ring 300 described above. The assembly of the jewelry item of the present disclosure is very simple, and the user only needs to twist a corresponding outer ring to make the corresponding outer ring to enter into a corresponding locking piece along a corresponding guiding channel. An assembly method of the jewelry item of the present disclosure is faster and simpler and has a shorter screwing stroke than an assembly method by a bolt in the prior. Further, the assembly method of the jewelry item of the present disclosure makes components of the jewelry item to be firmly interlocked comparing with the assembly method by the bolt, which prevents outer rings from falling off and solves a problem of losing the outer rings.

Compared with the prior art, the jewelry item with the freely combinable decorative elements of the present disclosure is more convenient for the user to assemble and disassemble, which greatly improves assembly time and efficiency, avoids a problem of falling off and losing of components due to bolt loosening, ensures safety of the user's property, and improves the user's experience and satisfaction. When assembly, the user is able to accurately and fast mount the first outer ring, the second outer ring, the inner ring, and the decorative body on the inner ring base, which solves a problem that the bolt is broken or slipped due to the use is unable to see the fixed hole of a conventional ring. The first outer ring, the second outer ring, the inner ring, and the decorative body are detachably arranged on an outer surface of the inner ring base. The first outer ring, the second outer ring, the inner ring, and the decorative body are replaceable, so the user is able to assemble the jewelry item as desired. According to different occasions and different clothes, the user is able to replace the first outer ring, the second outer ring, the inner ring, and the decorative body. Therefore, with the least cost, the jewelry item has many different forms due to different combinations of the decorative elements (the first outer ring, the second outer ring, the inner ring, and the decorative body), which improves the user's experience and satisfaction, and meets the user's need of changing an appearance of the jewelry item. In addition, in the jewelry item of the present disclosure, each first locking piece, each first locking portion, each first strip-shaped opening, each second locking piece, each second locking portion, and each second strip-shaped opening are integrally formed with the inner ring base, which increases consistency and stability of the jewelry item and increases the service life. Each first locking piece and each second locking piece are hardly deteriorate or fall off with increase of use time, which reduces an after-sale maintenance rate and brings convenience to both customers and businesses.

What is claimed is:

1. A jewelry item, comprising:

an inner ring base, an inner ring arranged on the inner ring base, and a decorative body;

wherein a slot is provided on an outer surface of the inner ring base; the inner ring defines a through hole at a position corresponding to the slot; the decorative body comprises a mounting column; the mounting column passes through the through hole and is limited in the slot;

wherein the jewelry item further comprises a first outer ring detachably arranged on a first end of the inner ring base and a second outer ring detachably arranged on a second end of the inner ring base; the inner ring is arranged between the first outer ring and the second outer ring;

wherein the first end of the inner ring base defines at least one first guiding channel; at least one first locking piece integrally formed on the inner ring base is arranged on the first end of the inner ring base; the at least one first locking piece comprises a first locking portion arranged in a tail portion of the at least one first guiding channel; the first outer ring comprises at least one first fastener corresponding to the at least one locking portion; the at least one first fastener is inserted into the tail portion of the at least one first guiding channel and the at least one first fastener is locked with the at least one locking portion; the second end of the inner ring base defines at least one second guiding channel; at least one second locking piece integrally formed on the inner ring base is arranged on the second end of the inner ring base; the at least one second locking piece comprises a second locking portion arranged in a tail portion of the at least one second guiding channel; the second outer ring comprises at least one second fastener corresponding to the at least one locking portion; the at least one second fastener is inserted into the tail portion of the at least one second guiding channel and the at least one second fastener is locked with the at least one locking portion.

2. The jewelry item according to claim 1, wherein the slot runs through the inner ring base along an axial direction of the inner ring base; the through hole is a strip-shaped through hole; the strip-shaped through hole cooperates with the slot to limit the mounting column; a length of the strip-shaped through hole is greater than a width of the slot; a locking block is arranged on a lower end of the mounting column; a length of the locking block is matched with the length of the strip-shaped through hole; a width of the locking block is matched with the width of the slot; when mounting the decorative body, the locking block is inserted into the strip-shaped through hole and is rotated 90 degrees, so a width direction of the locking block is consistent with a width direction of the slot; then the locking block is pushed into the slot.

3. The jewelry item according to claim 1, wherein the decorative body is selected from a flower-shaped clasp, a melon-seed-shaped clasp, an earring clasp, a bracelet clasp, a brooch clasp, or any object with a decorative effect.

4. The jewelry item according to claim 1, wherein the inner ring base defines at least one first strip-shaped opening parallel to the tail portion of the at least one first guiding channel; a portion between the at least one first strip-shaped opening and the tail portion of the at least one first guiding channel forms the at least one first locking piece; a middle portion of the at least one first locking piece extends into the at least one first guiding channel to form the at least one first locking portion; the inner ring base defines at least one second strip-shaped opening parallel to the tail portion of the at least one second guiding channel; a portion between the at least one second strip-shaped opening and the tail portion of the at least one second guiding channel forms the at least one second locking piece; a middle portion of the at least one second locking piece extends into the at least one second guiding channel to form the at least one second locking portion.

5. The jewelry item according to claim 4, wherein the at least one first locking piece, the at least one first locking piece, and the at least one first strip-shaped opening are integrally formed by precision computer numerical control (CNC) machining.

6. The jewelry item according to claim 4, wherein the at least one first locking portion is a first elastic hook in V shape; the at least one first elastic hook extends from the middle portion of the at least one first locking piece and extends into the at least one first guiding channel; the at least one second locking portion is a second elastic hook in V shape; the at least one second elastic hook extends from the middle portion of the at least one second locking piece and extends into the at least one second guiding channel.

7. The jewelry item according to claim 6, wherein the at least one first guiding channel runs through the inner ring base from a radial direction of the inner ring base; the at least one first guiding channel comprises a first bottom wall, a first guiding sidewall close to the first end of the inner ring base, and a second guiding sidewall opposite to the first guiding sidewall; the at least one first locking piece is arranged between the at least one first guiding channel and the at least one second guiding channel and is close to the at least one first guiding channel; one side of the at least one first locking piece facing the at least one first guiding channel forms the second guiding sidewall arranged in the tail portion of the at least one first guiding channel; a distance between the at least one first elastic hook and the at least one first guiding sidewall is less than a width of the at least one first guiding channel;

wherein the at least one second guiding channel runs through the inner ring base from the radial direction of the inner ring base; the at least one second guiding channel comprises a second bottom wall, a third guiding sidewall close to the second end of the inner ring base, and a fourth guiding sidewall opposite to the third guiding sidewall; the at least one second locking piece is arranged between the at least one second guiding channel and the at least one second guiding channel and is close to the at least one second guiding channel; one side of the at least one second locking piece facing the at least one second guiding channel forms the fourth guiding sidewall arranged in the tail portion of the at least one second guiding channel; a distance between the at least one second elastic hook and the at least one third guiding sidewall is less than a width of the at least one second guiding channel.

8. The jewelry item according to claim 1, wherein the at least one first guiding channel and the at least one first locking piece are provided on a position of the outer surface of the inner ring base close to the first end of the inner ring base; the at least one first guiding channel comprises a first inlet and a first guiding through groove extending from the first inlet along a circumferential direction of the inner ring base; the at least one first fastener is inserted into the first inlet along the axial direction of the inner ring base; the tail portion of the at least one first guiding channel is defined as one end of the first guiding through groove away from the first inlet;

wherein the at least one second guiding channel and the at least one second locking piece are provided on a position of the outer surface of the inner ring base close to the second end of the inner ring base; the at least one second guiding channel comprises a second inlet and a second guiding through groove extending from the second inlet along the circumferential direction of the inner ring base; the at least one second fastener is inserted into the second inlet along the axial direction of the inner ring base; the tail portion of the at least one second guiding channel is defined as one end of the second guiding through groove away from the second inlet.

* * * * *